United States Patent [19]

Solomon

[11] 4,173,984

[45] Nov. 13, 1979

[54] PNEUMATIC AMPLIFIER

[75] Inventor: Donald F. Solomon, Costa Mesa, Calif.

[73] Assignee: S/P Product Design, Inc., Newport Beach, Calif.

[21] Appl. No.: 914,607

[22] Filed: Jun. 12, 1978

[51] Int. Cl.[2] ..... F15B 13/043

[52] U.S. Cl. ..... 137/119; 137/596.16; 91/51

[58] Field of Search ..... 137/119, 596.18, 596.14, 137/596.10, 82; 251/61.1; 91/51, 47, 48, 459

[56] References Cited

U.S. PATENT DOCUMENTS

| | | | |
|---|---|---|---|
| 3,504,692 | 4/1970 | Goldstein | 137/119 |
| 3,598,020 | 8/1971 | Blok | 137/82 X |
| 3,738,227 | 6/1973 | Bitzer | 137/119 X |
| 3,770,012 | 11/1973 | Bitzer | 137/119 X |
| 3,789,864 | 2/1974 | Cowan | 137/119 |

*Primary Examiner*—Alan Cohan

*Attorney, Agent, or Firm*—Gordon L. Peterson

[57] ABSTRACT

A fluid amplifier comprising a housing having a cavity therein and a diaphragm in the housing dividing the cavity into first and second chambers. First and second supply passages lead to the first and second chambers, respectively, and terminate in first and second supply ports. The diaphragm is movable in the cavity to selectively substantially seal off the first and second supply ports. First and second control passages extend between the first and second supply passages and the first and second chambers. First and second signal passages are provided in the housing and terminate in the first and second chambers, respectively. The first and second control passages are in communication with the first and second signal passages through the first and second chambers regardless of which of the supply ports is sealed off by the diaphragm. First and second output passages terminate in the first and second supply passages, respectively.

13 Claims, 5 Drawing Figures

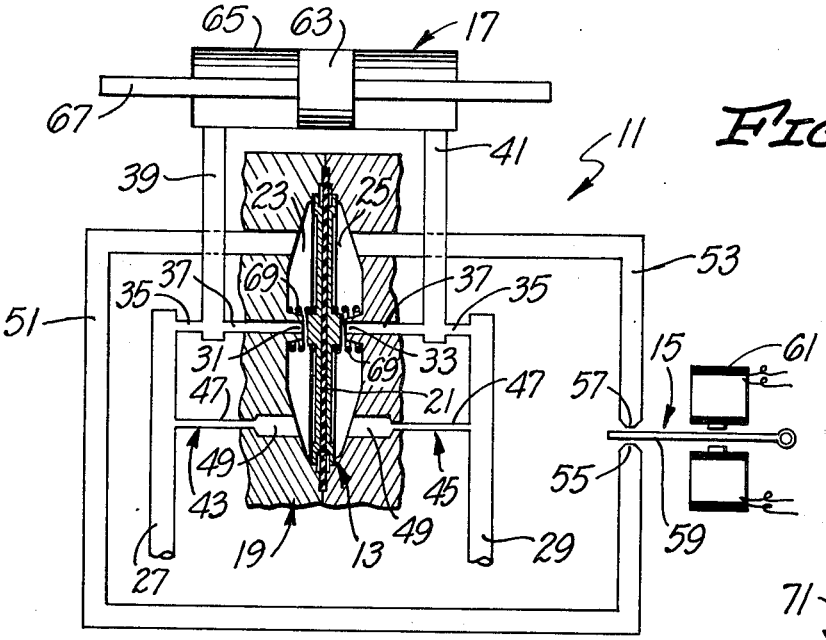
FIG. 1.
FIG. 5.
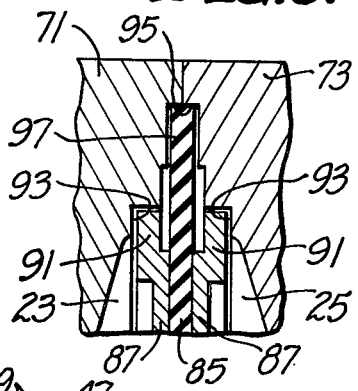
FIG. 2.
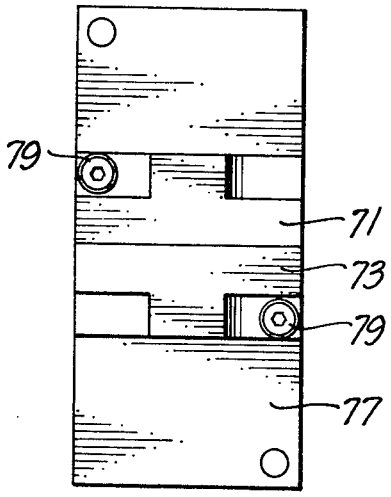
FIG. 4.
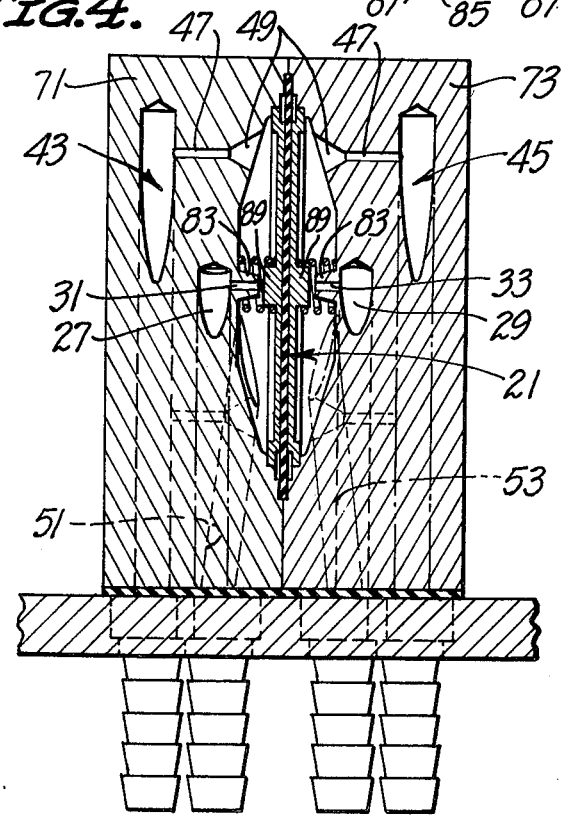
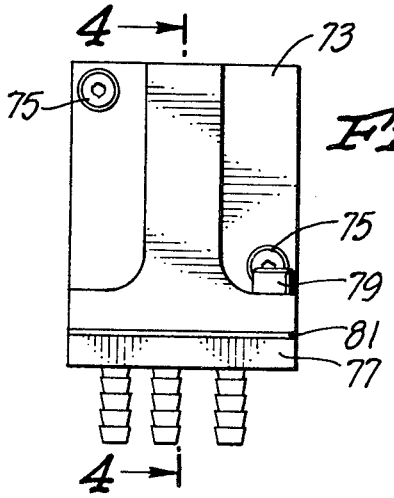
FIG. 3.

PNEUMATIC AMPLIFIER

BACKGROUND OF THE INVENTION

Fluid amplifiers, such as pneumatic amplifiers, are well-known devices which have a wide range of industrial and commercial applications. For example, fluid amplifiers may be used in sensors, such as product sensors, which detect the presence of a product at a particular station, or in servo systems which move or position an element, such as a switch, in response to a predetermined condition, such as temperature. Pneumatic control devices of general interest are disclosed in Bitzer et al U.S. Pat. No. 3,770,012, Cowan et al U.S. Pat. No. 3,789,864 and Blok et al U.S. Pat. No. 3,598,020.

SUMMARY OF THE INVENTION

This invention provides a fluid amplifier which has very rapid response and extreme sensitivity. The amplifier will respond to an extremely small signal.

These advantages can be embodied in a fluid amplifier which includes a housing having a cavity therein and a diaphragm in the housing for dividing the cavity into first and second chambers on opposite sides of the diaphragm. Supply passage means supplies fluid, such as air, under pressure to the first and second chambers. The supply passage means preferably includes first and second supply passages for supplying the fluid under pressure to the first and second chambers, respectively. The first and second supply passages terminate in first and second supply ports, respectively, in the first and and second chambers. The diaphragm is movable in the cavity is selectively substantially seal off the first and second supply ports.

To control diaphragm movement, i.e., to control which of the supply ports is blocked off by the diaphragm, the housing includes first and second control passages in the housing extending between the supply passage means and the first and second chambers, respectively, and first and second signal passages in the housing terminating in the first and second chambers, respectively. The control passages respond to signals from the signal passages for providing air under pressure from the supply passage means to initiate movement of the diaphragm from one of the supply ports to the other of the supply ports. The use of control passages and signal passages in this manner is one way in which this invention provides for extreme sensitivity and rapid response.

More particularly, in the absence of any restriction to airflow in the signal passages, air flows from both of the control passages through the associated chambers and is exhausted through the associated signal passages. This airflow is maintained regardless of which of the supply ports is being sealed off by the diaphragm. However, if airflow through the first signal passage is restricted, the pressure in the first chamber correspondingly increases as a result of airflow from the supply passage means through the first control passage. This increase in pressure occurs virtually instantaneously and will result from the presence of even a very slight restriction in the first signal passage. As a consequence, a differential pressure is instantaneously created which initiates movement of the diaphragm from the first supply port toward the second supply port.

Although this differential pressure acting alone would provide rapid response, this invention provides for a still more rapid response as a result of the diaphragm unsealing the first supply port. When the supply port is unsealed, fluid at supply pressure passes through the supply port to the first chamber to augment movement of the diaphragm.

This invention provides for first and second output passages which exhaust their fluid into the first and second chambers, respectively, in such a way as to further augment diaphragm movement. This can be accomplished, for example, by providing each of the output passages in communication with the first and second supply passages, respectively. Accordingly, when the first supply port is unsealed, the pressure within the first ouput passage can exhaust into the first chamber to further augment diaphragm movement.

To provide low pressure sensitivity, the supply of fluid under pressure to the chambers through the control passages is reduced. This can be accomplished by a restricted section in each of these control passages.

Each of the supply passages preferably includes first and second restricted sections. Each of the output passages preferably terminates in the associated supply passage intermediate the first and second restricted sections thereof in a known manner. The first or upstream restriction prevents flooding the output passage with high pressure air to such an extent that the amplifier could not properly control the load. To facilitate the exhausting of fluid under pressure from the output passages into the first and second chambers, the restriction which is more downstream in preferably of larger cross-sectional area. In addition, the second restriction should allow the air from the first restriction to escape without creating back pressure in the output passage.

Although the fluid amplifier is very sensitive and provides a rapid response in the fluidic sense, it is also important that the amplifier be mechanically capable of being sensitive and providing a rapid response. To further this purpose, the diaphragm preferably includes a resilient, flexible member which has a peripheral region received in a peripherally extending recess of the housing. The recess loosely receives the peripheral region of the flexible, resilient member so that it does not compressively load this peripheral region across its thickness. If this peripheral region were compressed across its thickness, buckling or other discontinuities may form in the diaphragm which would tend to make the diaphragm stiffer and/or provide it with a bias.

The diaphragm preferably includes protrusions in the cavity engageable with the supply ports, respectively, so as to provide an air escape route which is farther from the diaphragm. The protrusions deflect the air from the supply ports and make the device more stable. To increase the effective area of the diaphragm and to permit the diaphragm to withstand relatively high pressures, it can advantageously include plates on opposite sides of the flexible, resilient member which are stiffer than the flexible manner.

The amplifier may be bistable or monostable depending upon the desired results. The amplifier can be made bistable by making it completely symmetrical and can be made monostable by appropriately relatively sizing certain of the orifices or by providing a mechanical biasing force.

The invention, together with further features and advantages thereof, may best be understood by reference to the following description taken in connection with the accompanying illustrative drawing.

BRIEF DESCRIPTION OF THE DRAWING

FIG. 1 is a schematic view of a control apparatus, including a fluid amplifier constructed in accordance with the teachings of this invention.

FIG. 2 is a top plan view of one form of fluid amplifier constructed in accordance with the teachings of this invention.

FIG. 3 is a front elevational view thereof.

FIG. 4 is an enlarged fragmentary sectional view taken generally along line 4—4 of FIG. 3.

FIG. 5 is an enlarged fragmentary sectional view showing a preferred way of mounting the diaphragm in the housing.

DESCRIPTION OF THE PREFERRED EMBODIMENT

FIG. 1 shows an apparatus 11 which includes a fluid amplifier 13, a flapper device 15 for controlling the fluid amplifier, and an output device in the form of an actuator 17. The fluid amplifier 13 includes a housing 19 having a cavity therein and a diaphragm 21 in the housing dividing the cavity into chambers 23 and 25 on opposite sides of the diaphragm.

Supply passage means are provided in the housing for supplying fluid under pressure to the chambers 23 and 25. The supply passage means includes supply passages 27 and 29 which are suitably coupled to a source of fluid (not shown), such as air, under pressure. The supply passages 27 and 29 terminate, respectively, in supply ports 31 and 33 within the chambers 23 and 25. Preferably, only a very slightly movement, such as a few thousandths of an inch is required to move the diaphragm between the supply ports 31 and 33. Each of the supply passages 27 and 29 has restricted sections 35 and 37. Output passages 39 and 41 are provided in the housing 19 with these passages terminating in the supply passages 27 and 29, respectively, intermediate the restricted sections 35 and 37 thereof.

The fluid amplifier 13 has control passages 43 and 45 which extend between the supply passages 27 and 29 and the chambers 23 and 25. Each of the control passages has a restricted section 47 and a section 49 of larger cross section, with the section 49 opening into the associated one of the chambers 23 and 25.

The fluid amplifier 13 can be made to respond to various different conditions, and the flapper device 15 is shown purely for illustrative purposes. In the embodiment illustrated in FIG. 1, the signal passages 51 and 53 terminate in confronting signal orifices 55 and 57, respectively. The flapper device 15 includes a flapper 59 positioned between the signal orifices 55 and 57 and a suitable electromagnetic device, such as a torque motor 61, for positioning the flapper. The torque motor 61 can move the flapper 59 toward the signal orifice 55 to provide a restriction in the signal passage 51 or toward the signal orifice 57 to provide a restriction in the signal passage 53. Restricted vents 62 may be provided in each of the signal passages 51 and 53 to prevent either of the signal passages from being completely sealed off by the flapper 59. The restriction in the signal passages 51 and 53 provides a signal to which the fluid amplifier 13 immediately responds as described hereinbelow. The flapper device 15 is well known per se and, for this reason, is not described in greater detail herein.

The output from the fluid amplifier 13 can be used in different ways, and the use of the output to position the actuator 17 is purely illustrative. In the embodiment illustrated, the actuator 17 includes a piston 63 slidable in a housing 65 and having a rod 67 attached to the piston and movable therewith. The output passages 39 and 41 communicate with the interior of the housing 65 on the opposite sides of the piston 63. Accordingly, differential pressure in the output passages 39 and 41 can be used to position the piston 63 and the rod 67. In the embodiment shown in FIG. 1, the fluid amplifier 13 responds to a signal created by the flapper device 15 to position the piston 63.

Although the diaphragm 21 could be biased toward either of the ports 31 and 33, in the embodiment illustrated, the fluid amplifier 13 is completely symmetrical about the diaphragm 21, and the diaphragm is not biased in either direction, except as a result of differential restrictions in the signal passages 51 and 53. Thus, the supply passages 27 and 29, including the restricted sections 35 and 37, are identical to each other, and the control passages 43 and 45 are likewise identical. Of course, the signal passages 51 and 53 are also identical. As discussed more fully hereinbelow, the restricted sections 37 preferably have a greater cross-sectional area than the restricted sections 35. To keep the diaphragm 21 centered when no fluid pressure is applied to the fluid amplifier 13, identical coil compression springs 69 are provided in the chambers 23 and 25 to bear against the opposite faces of the diaphragm. If a mechanical bias is desired, one of the springs 69 can be made stronger than the other.

To illustrate the operation of the apparatus 11, let it be assumed that the flapper 59 is substantially blocking the signal orifice 57 and that the diaphragm 21 is engaging and sealing off the supply port 31. In this event, air at supply pressure passes from the supply passage 27 through the restricted section 35 and the output passage 39 to the lefthand side of the piston 63, and air from the righthand side of the piston 63 is vented through the signal orifice 57 via the output passage 41, the restricted section 37, the chamber 25, and the signal passage 53. Similarly, air from the supply passage 29 is vented through the restricted signal orifice 57 via the parallel passages provided by the control passage 45 and the restricted sections 35 and 37 to the chamber 25 and then to the signal passage 53. However, this relatively large airflow, coupled with the restriction provided at the signal orifice 57 by the flapper 59, provides a relatively high pressure in the chamber 25. At this same time, air from the supply passage 27 is vented through the unrestricted signal orifice 55 through the chamber 23 and the signal passage 51. Consequently, there is a relatively low pressure in the chamber 23. The differential pressure in the chambers 23 and 25 maintains the diaphragm 21 tightly seated against the supply port 31.

If the torque motor 61 moves the flapper 59 away from the signal orifice 57 and closely adjacent the signal orifice 55, the restriction to fluid flow out of the signal passage 53 is removed and a restriction to fluid flow out of the signal passage 51 is created. When this occurs, the relatively high fluid pressure in the chamber 25 can be immediately vented through the signal passage 53 because the signal orifice 57 is no longer restricted. However, the restriction in the signal passage 51, coupled with the continuous flow of air at supply pressure from the control passage 43 into the chamber 23, causes an instantaneous increase in pressure in the chamber 23. Accordingly, the differential pressure across the diaphragm 21 instantaneously reverses and tends to move the diaphragm 21 away from the supply port 31 and toward the supply port 33.

As soon as the diaphragm 21 unseats from the supply port 31, two additional factors cause extremely rapid movement of the diaphragm into engagement with the supply port 33. First, air at supply pressure from the supply passage 27 can now flow through the port 31 to increase the differential pressure acting on the diaphragm. In addition, the high pressure air in the output passage 39 and in the housing 65 to the left of the piston 63 can now exhaust through the supply port 31 into the chamber 23. This creates an avalanche effect which rapidly moves the diaphragm 21 into sealing engagement with the supply port 33. The rush of supply air from the restricted section 35 to the restricted section 37 creates an aspirator-type of effect which tends to exhaust the air from the output passage 39 very rapidly.

The fluid amplifier 13 can be constructed in different ways, and the manner shown in FIGS. 2–5 is purely illustrative. As shown in FIGS. 2–5, the housing 19 includes identical housing sections 71 and 73 suitably joined as by threaded fasteners 75, and a base plate 77 to which the housing sections are attached by threaded fasteners 79. A resilient gasket 81 is sandwiched between the base plate 77 and the housing sections 71 and 73. The housing sections 71 and 73 are identical and they provide the passages illustrated in FIG. 1. Each of the housing sections 71 and 73 provides an annular boss 83 through which the supply ports 31 and 33 extend.

With reference to FIGS. 4 and 5, the diaphragm 21 can advantageously includes a flexible, resilient member 85 sandwiched between identical members or plates 87 which are more rigid than the member 85. Each of the plates 87 has a central protrusion 89 adapted to confront the supply ports 31 and 33, respectively. For example, the flexible member 85 can be constructed of rubber, and the plates 87 can be constructed of thin metal. Each of the plates 87 has an annular offset 91 (FIG. 5) which is spaced axially from the flexible member 85 and which is received within annular grooves 93, respectively, formed in the housing sections 71 and 73. The plates 87 are received in the grooves 93 with axial and radial clearance so that the plates can reciprocate axially. The opposed springs hold the plates 87 against the flexible member 85. The arrangement is such that the plates 87 do not compress the flexible member 85 axially, i.e., across its thickness. Because the plates 87 can reciprocate, they need not be deflected and only a small force is required to move the diaphragm.

To provide a good seal between the chambers 23 and 25 without distorting the flexible member 85, the housing sections 71 and 73 have annular grooves which cooperate to define an annular recess 95 which loosely receives an annular peripheral region 97 of the diaphragm so that the housing sections 71 and 73 do not compress the annular region 97 axially across its thickness. Accordingly, the flexible member 85 is not deformed in such a way as to create the bias on the diaphragm 21 or added stiffness of the diaphragm. A seal between the chambers 23 and 25 is maintained notwithstanding the loose manner in which the peripheral region 97 is received between the housing sections 71 and 73 because the differential air pressure across the diaphragm 21 urges the peripheral region 97 of the flexible member against one of the housing sections so as to provide a proper seal.

Although an exemplary embodiment of the invention has been shown and described, many changes, modifications and substitutions may be made by one having ordinary skill in the art without necessarily departing from the spirit and scope of this invention.

I claim:

1. A fluid amplifier comprising:

a housing having a cavity therein;

a diaphragm in said housing dividing said cavity into first and second chambers on opposite sides of the diaphragm;

supply passage means in said housing for supplying fluid under pressure to said first and second chambers, said supply passage means including first and second supply passages for supplying fluid under pressure to the first and second chambers, respectively, said first supply passage terminating in a supply port in said first chamber and said second supply passage terminating in a second supply port in said second chamber;

said diaphragm being movable in said cavity to selectively substantially seal off said first and second supply ports;

a first control passage in said housing extending between said supply passage means and the first chamber;

a second control passage in said housing extending between said supply passage means and the second chamber;

first and second signal passages in said housing terminating in said first and second chambers, respectively;

said first control passage being in communication with said first signal passage through said first chamber regardless of which of the supply ports is sealed by the diaphragm;

said second control passage being in communication with said second signal passage through said second chamber regardless of which of the supply ports is sealed by the diaphragm whereby the fluid from the first and second control passages can pass through the first and second chambers and enter the first and second signal passages, respectively, and the presence of a restriction to flow in the first signal passage causes an increase in pressure in the first chamber;

first output passage means in said housing for receiving fluid under pressure from the supply passage means when the first supply port is sealed off by the diaphragm; and second output passage means in said housing for receiving fluid under pressure when the second supply port is sealed off by the diaphragm.

2. An apparatus comprising:

a housing having a cavity therein;

a diaphragm in said housing dividing said cavity into first and second chambers on opposite sides of the diaphragm;

supply passage means in said housing for supplying fluid under pressure to said first and second chambers, said supply passage means including first and second supply passages for supplying fluid under pressure to the first and second chambers, respectively, said first supply passage terminating in a supply port in said first chamber and said second supply passage terminating in a second supply port in said second chamber;

said diaphragm being movable in said cavity to selectively substantially seal off said first and second supply ports;

first output passage means in said housing communicating with said first supply passage for receiving fluid under pressure when the first supply port is sealed off by the diaphragm;

second output passage means in said housing and communicating with said second supply passage for receiving fluid under pressure when the second supply port is sealed off by the diaphragm;

first and second signal passages in said housing terminating in said first and second chambers, respectively; and means communicating with said first chamber and said supply passage means and responsive to a signal in said first signal passage at least when the diaphragm seals off the first supply port for providing fluid under pressure to said first chamber in response to said signal to at least initiate movement of the diaphragm away from the first supply port and toward the second supply port whereby after the first supply port is opened fluid can escape from the first output passage means through the first supply port to augment movement of the diaphragm toward the second supply port.

3. An apparatus as defined in claim 2 wherein the last-mentioned means communicates with said first chamber and said supply passage means and provides fluid under pressure to said first chamber in response to said signal to at least initiate movement of the diaphragm away from the first supply port.

4. An apparatus as defined in claim 2 including means for creating said signal in said first signal passage and positionable pressure responsive means responsive to the pressures in said first and second output passages.

5. A fluid amplifier comprising:

a housing having a cavity therein;

a diaphragm in said housing dividing said cavity into first and second chambers on opposite sides of the diaphragm;

supply passage means in said housing for supplying fluid under pressure to said first and second chambers, said supply passage means including first and second supply passages for supplying fluid under pressure to the first and second chambers, respectively, said first supply passage terminating in a supply port in said first chamber and said second supply passage terminating in a second supply port in said second chamber;

said diaphragm being movable in said cavity to selectively substantially seal off said first and second supply ports;

a first control passage in said housing extending between said supply passage means and the first chamber;

a second control passage in said housing extending between said supply passage means and the second chamber;

first and second signal passages in said housing terminating in said first and second chambers, respectively;

said first control passage being in communication with said first signal passage through said first chamber regardless of which of the supply ports is sealed off by the diaphragm;

said second control passage being in communication with said second signal passage through said second chamber regardless of which of the supply ports is sealed off by the diaphragm; and first and second output passages terminating in said first and second supply passages, respectively.

6. A fluid amplifier as defined in claim 5 wherein said first control passage includes a restricted passage section.

7. A fluid amplifier as defined in claim 5 wherein said first supply passage includes first and second restricted sections and said first output passage terminates in said first supply passage intermediate said restricted sections.

8. A fluid amplifier as defined in claim 7 wherein said second restricted section is downstream in said first supply passage from said first restricted section and has a larger cross-sectional area.

9. A fluid amplifier as defined in claim 5 wherein said diaphragm includes a protrusion in said cavity, said protrusion being engageable with said first supply port to substantially seal the same.

10. A fluid amplifier as defined in claim 5 wherein said diaphragm includes a flexible, resilient member having a peripheral region and said housing includes a peripherally extending recess for receiving said peripheral region of the flexible, resilient member without compressively loading the peripheral region across its thickness.

11. A fluid amplifier as defined in claim 5 wherein said diaphragm includes a flexible, resilient member and first and second members of greater rigidity than said flexible, resilient member, said flexible, resilient member being sandwiched between said first and second members, and said first and second members being mounted for reciprocation in said housing.

12. A fluid amplifier as defined in claim 11 including opposed springs for urging said first and second members toward said flexible member.

13. A fluid amplifier as defined in claim 5 wherein each of said control passages includes a restricted passage section, each of said supply passages includes first and second restricted sections, each of said output passages terminates in its associated supply passage intermediate the restricted sections thereof, each of said second restricted sections being downstream of the associated first restricted section and having a larger cross-sectional area.

* * * * *